US008960059B2

(12) United States Patent
Baumuller et al.

(10) Patent No.: US 8,960,059 B2
(45) Date of Patent: Feb. 24, 2015

(54) VARIABLE FOLDING SYSTEM COMPRISING LINEAR DRIVES, ESPECIALLY FOR PRINTING MACHINES

(75) Inventors: Andreas Baumuller, Nuremberg (DE); Fritz Rainer Gotz, Kirchheim unter Teck (DE)

(73) Assignee: Baumuller Nurnberg GmbH, Nuremberg (DE)

( * ) Notice: Subject to any disclaimer, the term of this patent is extended or adjusted under 35 U.S.C. 154(b) by 442 days.

(21) Appl. No.: 13/376,603

(22) PCT Filed: Jun. 8, 2010

(86) PCT No.: PCT/EP2010/058027

§ 371 (c)(1), (2), (4) Date: Dec. 28, 2011

(87) PCT Pub. No.: WO2010/142691

PCT Pub. Date: Dec. 16, 2010

(65) Prior Publication Data

US 2012/0111163 A1 May 10, 2012

(30) Foreign Application Priority Data

Jun. 8, 2009 (DE) ..... 10 2009 026 828

(51) Int. Cl.
*B26D 7/06* (2006.01)
*B26D 5/20* (2006.01)
(Continued)

(52) U.S. Cl.
CPC *B26D 5/20* (2013.01); *B26D 1/085* (2013.01); *B26D 5/34* (2013.01); *B26D 7/015* (2013.01);
(Continued)

(58) Field of Classification Search
CPC ..... B26D 1/085; B26D 5/34; B26D 7/18; B26D 2007/0043; B26D 5/20; B26D 7/015; B26D 7/20; B26H 20/22; B65H 35/04; B65H 45/18; B65H 2555/132; B65H 2511/222; B65H 2220/01; B65H 2220/02; B65H 29/10; B65H 45/12; B65H 2555/13
USPC ..... 83/23, 78, 109, 22, 102, 650, 34, 37, 83/318, 370; 270/21.1, 4, 5, 41, 42, 10, 270/54, 52.5, 1.1, 58.08; 58/389, 203, 168, 58/222; 198/366, 369, 575; 226/110; 399/407; 271/3.18
See application file for complete search history.

(56) References Cited

U.S. PATENT DOCUMENTS 3,031,185 A * 4/1962 Brien ..... 493/444
3,493,226 A * 2/1970 Weir ..... 493/19
(Continued)

FOREIGN PATENT DOCUMENTS

DE 840 551 6/1952
DE 29 17 616 1/1980
(Continued)

*Primary Examiner* — Ghassem Alie
(74) *Attorney, Agent, or Firm* — Frank H. Foster; Kremblas & Foster

(57) ABSTRACT

A method for producing individual material sections, particularly sheets of paper, according to a certain format, from a web-type, for example imprinted object (object web), more particularly a web of paper or material, using a cutting means for cutting off the individual material sections from the object web and then removing said sections from the cutting means, wherein during the course of actuation of the cutting means at least one carrier is engaged with the object web, wherein following the cutting process, the carrier is displaced, together with the object web gripped by said carrier, by means of a controllable linear drive, over a displacement stroke, which is adjusted and/or varied in a controlled manner by the linear drive according to a section format that is predefined for the material section.

18 Claims, 2 Drawing Sheets

Figure 1:
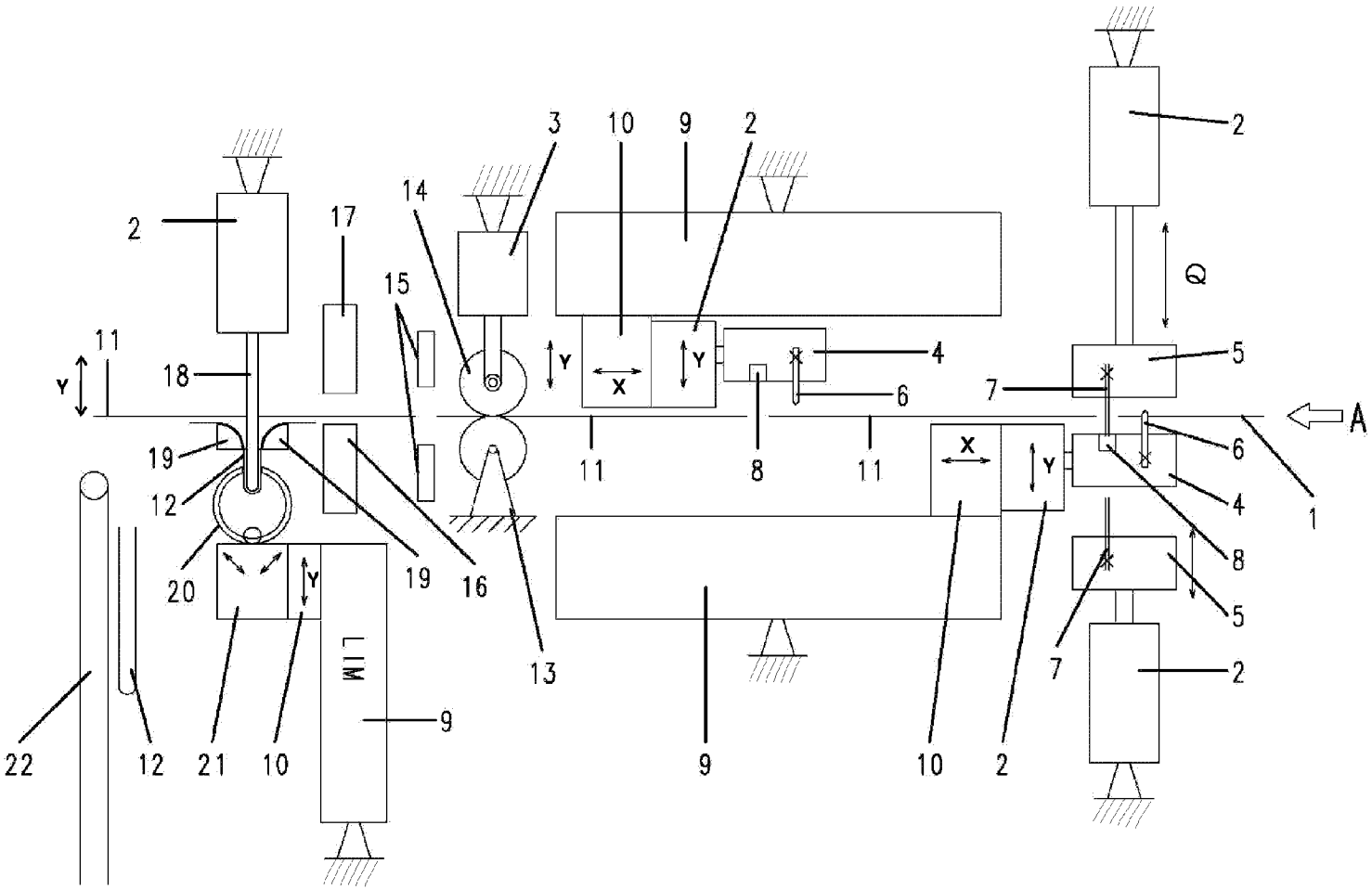

(51) Int. Cl.

| | |
|---|---|
| ***B26D 1/08*** | (2006.01) |
| ***B26D 5/34*** | (2006.01) |
| ***B26D 7/01*** | (2006.01) |
| ***B26D 7/18*** | (2006.01) |
| ***B26D 7/20*** | (2006.01) |
| ***B65H 20/22*** | (2006.01) |
| ***B65H 29/10*** | (2006.01) |
| ***B65H 35/04*** | (2006.01) |
| ***B65H 45/12*** | (2006.01) |
| ***B65H 45/18*** | (2006.01) |
| ***B65H 45/28*** | (2006.01) |
| *B26D 7/00* | (2006.01) |

(52) U.S. Cl.
CPC .. *B26D 7/18* (2013.01); *B26D 7/20* (2013.01); *B65H 20/22* (2013.01); *B65H 29/10* (2013.01); *B65H 35/04* (2013.01); *B65H 45/12* (2013.01); *B65H 45/18* (2013.01); *B65H 45/28* (2013.01); *B26D 2007/0043* (2013.01); *B65H 2511/11* (2013.01); *B65H 2511/222* (2013.01); *B65H 2555/13* (2013.01); *B65H 2555/132* (2013.01)
USPC ..... 83/78; 83/23

(56) References Cited

U.S. PATENT DOCUMENTS

| | | | | |
|---|---|---|---|---|
| 3,752,469 | A * | 8/1973 | Kistner | 493/357 |
| 3,889,562 | A * | 6/1975 | Schiesser | 83/94 |
| 4,825,622 | A * | 5/1989 | Nigg | 53/203 |
| 6,070,509 | A * | 6/2000 | Lonn et al. | 83/34 |
| 7,338,345 | B2 * | 3/2008 | Fujinami | 451/5 |
| 2005/0189688 | A1 * | 9/2005 | Suzuki et al. | 270/32 |

FOREIGN PATENT DOCUMENTS

| | | | |
|---|---|---|---|
| DE | 38 40 856 | A1 | 7/1989 |
| DE | 198 43 872 | A1 | 3/2000 |
| DE | 200 00 554 | U1 | 5/2000 |
| DE | 100 55 582 | A1 | 6/2001 |
| DE | 101 33 213 | A1 | 1/2003 |
| DE | 10 2008 012 812 | A1 | 11/2008 |
| EP | 0 335 190 | A2 | 10/1989 |
| EP | 1 247 757 | A1 | 10/2002 |

* cited by examiner

VARIABLE FOLDING SYSTEM COMPRISING LINEAR DRIVES, ESPECIALLY FOR PRINTING MACHINES

BACKGROUND OF THE INVENTION

The invention relates to a method for producing individual material sections, more particularly, sheets of paper, according to a certain format, from a web-type, for example, imprinted object (object web), more particularly, a web of paper, fabric, plastic, or metal foil, wherein at least one separating means is used, with which the individual material sections are cut from the object web and are then removed from the cutting means. During the course of the cutting process or the actuation of the cutting means, at least one carrier is engaged with the object web. The invention further relates to a corresponding device for separating individual material sections, according to a certain format, from a web-type object (object web), wherein a cutting tool that can be brought into functional connection with the object web is provided, along with one or more transporting or conveying means. The latter are embodied for removing the separated material section once it has been cut off by the cutting tool. The transporting or conveying means comprise at least one carrier, which is embodied for engaging with and/or gripping the object web.

The invention further relates to a method for folding a material section, which can be an imprinted sheet of paper, for example, and has been produced particularly according to the above-described production and/or separation method. In this, a folding element is pressed against the cut-off material section in the region of an intended folding line. The invention further relates to a corresponding device for folding the material section, comprising a folding tool, which can be placed in engagement with the material section in the region of the intended folding line. Additionally, a gripper or some other type of carrier is allocated for interacting with the folding tool. The carrier can be placed in functional connection with or disconnected from the material section by means of a servo device.

Finally, the invention relates to a cutting and folding assembly for material in web or sheet form, for example, an imprinted paper web or imprinted sheets of paper, wherein the above-described separating and folding devices can be used.

Folding units are known in the field of printing machines, for example, for web-fed offset machines. The embodiment of said units as jaw folding units is particularly common. Coming from a fold former, a strand or an object web first reaches a cross-cutting unit, which consists of a two-part cutting blade cylinder, for example, which operates opposite a three-part folding blade cylinder. For this purpose, the latter is equipped with three cutting bars made of a flexible but sturdy material. The cutting blade is serrated in the manner of a saw, and executes a punching cut, in which the ends of the sheet, after being cut, therefore also appear serrated. The manner of folding by way of folding blade and folding jaw is characteristic of a jaw folding unit. To accomplish this, after cutting, a three-part folding blade cylinder and a two-part folding jaw cylinder, for example, interact. The jaw fold is produced in that, at the point of contact between folding blade and folding jaw cylinder, the folding blade emerges, cam-controlled, from the periphery of the cylinder, thereby forcing a multilayered, cut strand packet (sheets), for example, into the opened folding jaw, which is also cam-controlled. The folding jaw, which consists of a spring-mounted steel bar with an opposite bar, then immediately closes, and holds the (folded) product securely in place as the cylinder continues to move. After the folding process, the folding jaw reopens under cam control, and separation tongues that engage in grooves in the cylinder remove the folded product from the cylinder surface and allow it to fall, under gravitational and centrifugal force, leading with the spine of the fold, into a paddle wheel, where the product is braked between the curved paddles and is delivered in a fanned form (cf., Kipphahn (editor): Handbuch Printmedien [Handbook of Print Media], Springer Verlag 2000, pages 298-300).

EP 0 335 190 B1 discloses a folding unit comprising a collecting and folding cylinder. In addition to this cylinder, a cutting cylinder and a folding jaw cylinder are also provided.

EP 1 247 757 A1 describes a printed sheet folding device comprising a saddle-shaped folding blade, on which the printed sheets are folded in continuously running operation. The folding blade has a vertical, internal guiding element, which interacts with an outer, revolving folding element in the form of a revolving conveyor belt for folding the printed sheets.

DE 29 17 616 C2 describes a folding blade drive, which has a traveling linear motor. With every stroke of the secondary part of the motor, a folding blade is pressed in a downward direction, and presses a sheet to be folded between two folding rollers having stationary axes of rotation. The two opposite folding rollers continue to transport the folded sheets. A substantially similar folding assembly is also disclosed by DE 198 43 872 A1.

DE 10 2008 012 812 A1 describes a folding machine for a printing press. The folding machine comprises, among other elements, a folding cylinder, a holding cylinder, a conveyor belt section, a chopper folding device, two folding blade wheels and discharge conveyor devices. On the periphery of the folding cylinder, two pairs of folding blades are provided at intervals of approximately 180°. Also provided on the periphery of the folding cylinder are a pin device for web conveyance and a severing blade for severing the web. The folding cylinder presses the pins of the pin device onto the leader of the web and rotates while holding the web still. The chopper folding device comprises, among other elements, a chopper blade, which is moved back and forth vertically through a loop movement of a chopper arm, at a predefined timing sequence.

DE 100 55 582 A1 describes a device and a method for cutting a web, to be applied in web-fed rotary printing presses. Said device and method are provided for cutting a web into signatures of variable section lengths. To this end, the device is equipped with a plurality of cutting elements, which are movable in a straight line in the web direction for cutting the web into signatures, and is equipped with a plurality of gripper elements, which interact with the cutting elements. The cutting elements are moved in the signature cutting region in a straight line in the web direction. The signatures are gripped, and the length of the signatures is adjusted by controlling the distances between the cutting elements. Because the cutting elements and the gripper elements are able to enter the signature cutting region in a controlled manner, the signature length can be adjusted by controlling the distance between successive pairs of cutting and gripper elements in the signature cutting region.

DE 200 00 554 U1 describes a cutting press for cutting workpieces out of a foil. A height-adjustable cutting tool is disposed above a press bed plate. On both sides of the press bed plate, storing parts for blanked parts that have been blanked by the cutting tool are provided. Two cutting tools are rigidly connected to one another and can be moved together transversely such that one storing part is always covered by a cutting tool when the other cutting tool is positioned above the press bed plate. This enables an automatic delivery of blanked parts at the highest possible production speed.

DE patent publication 840 551 discloses a device for the incremental forward movement and the periodic cutting off of a packaging tape in an automatic folding machine. After each cutting process and before subsequent forward movements, the part of the tape that is to be cut off in the subsequent cutting operation is automatically retracted by an adjustable amount. Also provided are means for executing a control movement of constant amplitude and a loop-type sliding track, the position of which during operation can be adjusted as desired. In the sliding track, a sliding block is disposed for executing back and forth movements in the sliding track. This sliding block transfers a component of the back and forth movement to elements that are engaged with the tape, for the purpose of retracting said tape.

DE 101 33 213 A1 describes a cutting device for plate-type building panels. The cutting device is structured in the form of a table. A turntable, which is swivelable about its vertical axis, is recessed in the table surface, and has a blade clearance which is such that the cutting and milling tools acting from above and below on the plate-type building panel that is to be cut execute a longitudinal movement along the blade clearance. A cut extending transversely to the direction of transport of the building panel is also enabled thereby. The plate-type building panels are moved floating on a cushion of air above the table surface.

Particularly in the case of rotating folding units having rotating cutting blade cylinders, folding blade cylinders and folding jaw cylinders, the definition of the circumference of the folding blade cylinder results in a definition of a specific, whole-number multiple of the folding format to be produced (section length). More particularly, the folding blade cylinder and the cutting blade cylinder are implemented as rotating components with defined circumferential ratios. These ratios, together with the associated folding jaw cylinder, are geared for one print format. The folding format or the section length, which is determined according to the distance between the cutting tools on the outer surface of the cutting cylinder, is thus permanently established for the printing press in advance, and thereafter can no longer be adjusted.

SUMMARY OF THE INVENTION

In contrast to the above, a method is described for producing material sections according to a certain format using the corresponding separating device also described herein, and the folding method described herein using the corresponding folding device described herein are proposed. An assembly comprising a combination of the separating or cutting device and the folding device according to the invention is described herein. Optional, preferred embodiment examples and configurations of the invention also described.

The known embodiment comprising cylinders, wherein the circumferential ratios and the arrangement of tools on sections of the circumference of said cylinders determine the format that can be processed, is replaced by an arrangement of tools and tool supports on linear guides and cross tables. According to a preferred embodiment example, said linear guides and cross tables lie in pairs opposite one another, and are each disposed adjacent to the material web/object web. Thus the reciprocal, particularly alternating action of said elements on the material web is enabled. Due to the optional use of multiple linear guides integrated into cross tables, arcuate movements of the tool supports can also be carried out. These movements can be synchronized in sections with the transport speed of the material web/fabric panel.

Because within the scope of the invention, the coupling of a circumferential speed of a cylinder, for example, a cutting blade cylinder or folding blade cylinder, with the transport speed of a material web is eliminated, any variable section lengths or folding formats can be realized. This is enabled by the free motion control of the tools that are not engaged with the material web (for example, cutting blades, grippers or spur needles), along with the mounts and drive systems thereof.

When printing machines are in use, the object to be processed can be received from a known former apparatus. At the end of the separating and folding process, the folded products can be transferred in a customary manner to a paddle wheel or a belt delivery system. Therefore, the invention allows increased flexibility of the folding system or folding apparatus to be achieved, without requiring any changes to system parts disposed upstream or downstream thereof.

The separating and folding assembly according to the invention is suitable for use with any type of materials, more particularly, for those materials that can be transported only via the action of a tractive force (for example, paper, fabric, foils).

The solution according to the invention is particularly characterized by the following aspects:

The tool elements provided for acting on the object web, and linearly guided according to the invention, are arranged in pairs, along and on both sides of this object web. A reciprocal engagement of the tool elements on the object web, for example, in a push-pull process, is thereby enabled. Only during the time segment of engagement with the object web or material web must the relevant tool element be moved synchronously with said object web or material web. The linear guides for the folding blade and for the folding jaw gripper are also located to the left and the right, or on both sides, of the (already cut) material section.

The drive system for the folding system according to the invention is implemented substantially by linear drives. The corresponding linear axes or linear guides can overlap one another across a plurality of linear drives. Thereby, curved movements or arcuate displacement paths can be implemented in one plane (in the manner of known cross tables). As a result of the overlapping of two linear movements, for example, a tool, which is mounted and guided in a two-axis guidance system, for example, a cross table, travels any movement path, even a curved, arcuate movement path, in a single plane. In this, there are segments of a movement path in which the tool held on the cross table is to be engaged with the material web. In these segments, the tools must move synchronously with the direction of transport of the material web or object web, since otherwise said webs will tear. In web sections where there is no engagement, the tools can move asynchronously, since, for example, they are moved opposite the direction of transport of the material web or object web.

Within the scope of the invention, in replacing the cutting blade cylinders and folding blade cylinders, the tools for processing the object web and/or the separated material section are variably positioned by way of the linear drives. Said linear drives support, for example, a cutting blade and the corresponding opposite element, the cutting bar. The cut products (material section) are guided between parallel linear drives, for example, with spur needles. With the replacement of the folding blade cylinder and the other folding rollers by gripper elements or other tool elements on linearly guided tool supports, according to the invention, even arcuate paths can be implemented in sections, synchronously with the material web or with the material section, by applying the cross table principle.

According to the invention, the cutting blade cylinders, folding blade cylinders and folding jaw cylinders used in known folding units are replaced by an assembly comprising a plurality of linear drives. More particularly, if said linear drives are equipped with displaceable carriages, different displacement profiles, from which different section lengths and/or variable folding formats can then be derived, can be achieved through variable control. On the basis of the invention, the control of the movement of the object web tools or material section tools is carried out independently of the object web when said tools are not engaged with the object web. This effect can be utilized to achieve an increase in flexibility and variability. The following advantages over the prior art can be achieved with the invention:

The folding format and/or the section length can be flexibly adjusted according to user requirements. The section length can even be modified during an ongoing production run, and can even be adjusted as desired within a wide range of parameters.

By replacing the cylinders with linear drives, a reduction in the masses that are moved, and therefore a faster shutdown of the machine are achieved. The safety level is thereby raised. In the case of a web tear or a severing of the web (i.e., the object web is deliberately cut through by special elements upstream of the folding unit) the linearly moved tool elements, which are engaged with the object web, can be quickly opened and separated from the object web. This reduces the quantity of waste paper that is produced.

The motion principle that is generally used according to the invention is the synchronized, alternating arresting and pulling of the object web. The web can be arrested using spur needles, suction chambers, electrostatic membrane actuators or even adhesive elements.

For supporting and guiding the object web tools and object web gripper elements, multiaxis drive systems and/or guidance systems, particularly cross tables, having a plurality of combined linear axes or linear guides can be used. These extend at an angle relative to one another, preferably 90°, so that the plane of motion of the relevant tool element supported on the cross table, for example, lies perpendicular to the plane that is defined by the direction of transport of the material web or object web, and the width thereof. The tool elements guided by multiple axis drive systems and/or guidance systems can execute arcuate movements. Expediently, these systems are cross tables, for example, arranged in pairs on both sides of the object web, which are able to execute movements both synchronously and asynchronously in relation to the object web. A further preferred embodiment consists in that the multiple axis drive systems and/or guidance systems, for example, cross tables, are connected with their respective longer axes stationary. In this manner, the dynamic stresses occurring as a result of the movement of the other axis and the tool parts supported thereon, and the forces of inertia that are to be overcome, can be minimized.

To achieve a coupling element between a functional surface of the object web tool and the cross table or other multiple axis guidance system, according to one optional example of the invention, bars can be provided as support elements or other linear tool supports. Above these, for example, spur needles or even cutting elements or gripping elements can extend, each across the entire width of the material web or object web. In the prior art, these bars are the respective tool supports on the tool-supporting cylinders of the folding unit.

Within the framework of the folding system according to the invention, a folding system controller is provided, which controls the movements of all axes interacting in the folding unit simultaneously and comprises an interface with another, higher level controller of an overall system or machine, for example, a higher level printing machine. With the interface, data communications between the folding system controller and the higher level machine controller can be established. The positioning of markings on the object web serves as a guiding variable, for example, wherein these markings can be actual (imprinted) or virtual, i.e., markings implemented through electronic data per software. The term "virtual marking" stems from the context of the virtual guide axis, which is known in the art of modern printing machines and refers to a position marking, which indicates the position of the material web at a specific point in time, and from which, via place-time functions or the associated first three differential quotients (speed, acceleration and slip), the positions of the individual drives are determined. In this case, this marker, which can be conceived of three-dimensionally as a printing mark on the material web, is updated at regular intervals and from this, corrections are calculated, if applicable.

Within the framework of an optional embodiment of the invention, the displacement profile of the linear guides and/or linear axes is influenced with a ramped start-up and slowdown for implementing a synchronization with the position and speed of the object web. In this manner, a so-called "chipping" of the object web tools into the material web or object web can be prevented. The web movement variables (web path, web speed, web acceleration and web slip) of the linear axes and linear guides are chosen such that a so-called "flying" positioning of the tools in relation to the material web is enabled, in other words, an asynchronous movement of a tool up to the material web. Once the tool has been engaged with the material web or object web, the tool movement is operated synchronized with the movement of the material web or object web.

For the linear axes and cross table axes, servo linear drives are preferably used. However, within the scope of the invention, roller bearings, ball screws, threaded spindles, spindle drives, rack pinion drives, toothed pulley drives, or even pneumatic or hydraulic drives would also be practicable.

To prevent an object web tool from colliding with an adjacent object web tool, an optional embodiment comprises a "space-creating" displacement segment. This refers to the displacement of a tool and a tool mount to make way for an adjacent tool.

BRIEF DESCRIPTION OF THE SEVERAL VIEWS OF THE DRAWING(S)

Figure 2:
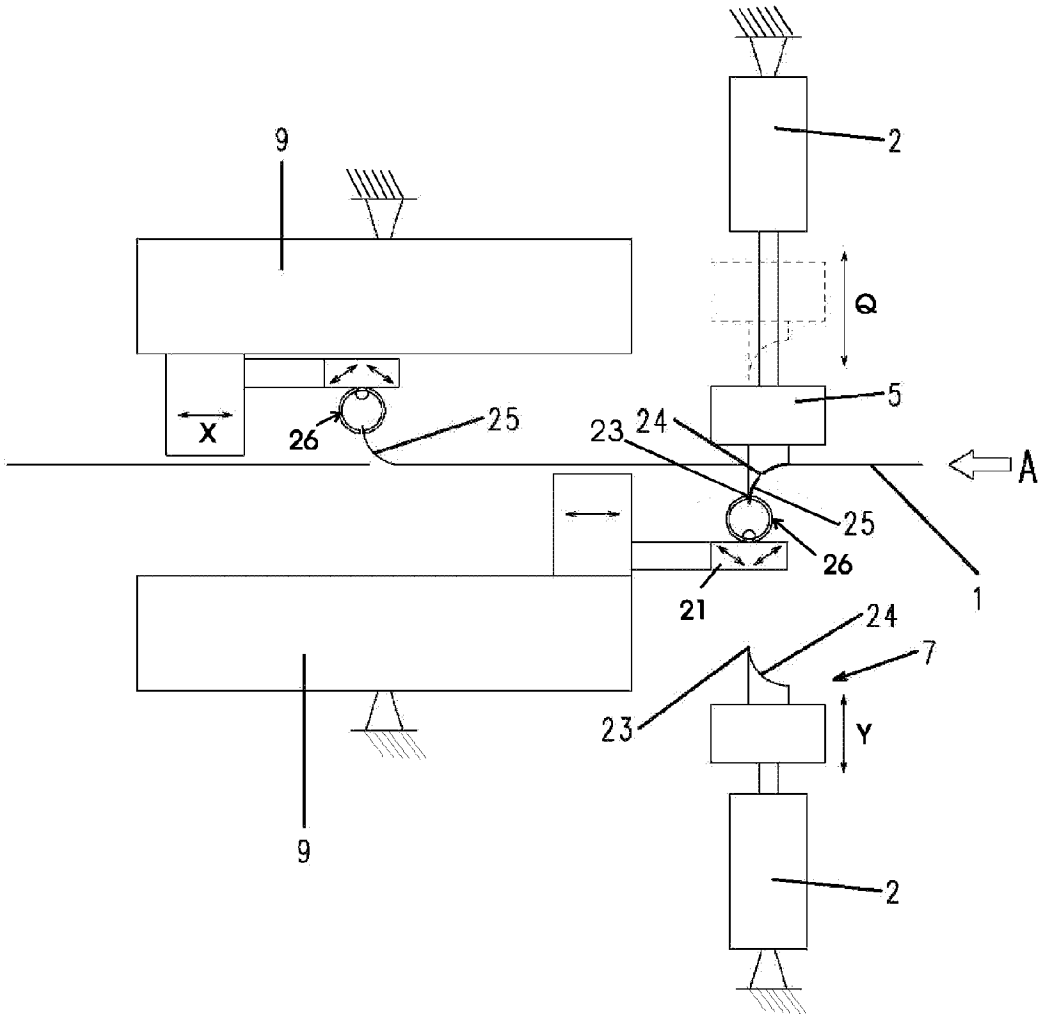

Further details, features, advantages and effects, combinations of features and sub-combinations of features on the basis of the invention are provided in the following description of preferred embodiments of the invention and the set of drawings. The drawings show, each from a schematic side view, FIG. 1 the entire folding system comprising a separating device and the folding device downstream thereof, arranged in series;

FIG. 2: an alternative embodiment of the separating device.

DETAILED DESCRIPTION OF THE INVENTION

According to FIG. 1, a material web or object web 1, for example, a web of print substrate, is fed to the folding unit or folding system according to the invention, in a direction of transport A. On both sides of the object web 1, in the direction of transport A, cutting means 5, 7 are first disposed, each said cutting means being linearly displaceable back and forth in a transverse direction Q, transversely to the direction of transport A of the object web, with a predefined displacement stroke, by way of a stationarily supported solenoid actuator 2. The cutting means 5, 7 comprise a cutting tool support 5 and a cutting blade 7, which projects outward from said support in the direction of the object web 1. The cutting means 5, 7 on both sides are arranged and driven along a linear guide axis y, parallel to the transverse direction Q, so as to be alternatingly brought into cutting engagement with the object web 1, in order to repeatedly and/or regularly separate sheets or material sections 11, cut from said web, in a predefined section length (folding format).

Additionally, on each of the two sides of the object web 1 or the cut material sections 11 or sheets, a carrier device 4, 6 is arranged. The carrier device comprises at least one spur needle 6 that projects toward the object web 1 and at least one cutting bar 8, which is assigned as a counter element to the above-described cutting blade 7. For this purpose, the cutting bar 8 can be embodied so as to be flexibly pressed in by the tip of the cutting blade. The respective carriers 4, 6 are displaceable on a two-axis linear drive 2, 10, 9 in the manner of a cross table, both along the object web 1, or cut sheets 11, or the material sections (linear guide axis x) and perpendicular thereto (linear guide axis y). The two displacement axes x, y are preferably located within a shared plane, according to the cross table principle, and extend perpendicular to one another. The linear guide axis y that extends perpendicular to the object web 1 or to the cut sheet or material section 11 is implemented as the first linear drive by way of a solenoid actuator 2. Said linear drive uses a predefined stroke to displace the support 4 for the spur needle 6 and the cutting bar 8 such that the spur needle 6 can punch into the object web and can carry the web along in the direction of the linear guide axis x, along the object web 1 or the material section 11. At the time of actuation of the cutting blade 7, the cutting bar 8 is available as a pressure pad for the tip of the cutting blade 7, which, displaced by the solenoid actuators 2, cuts off the material sections or sheets 11.

To implement the carrier function, the linear guide axis x is used, which extends parallel to the transport direction A, and along which a sliding carriage 10 can be moved back and forth in a controlled manner in a guide base of a linear motor 9. In this sliding carriage 10, in turn, the above-described solenoid actuator 2 is mounted so as to be displaceable in a controlled manner for implementing the linear guide axis y, perpendicular to the direction of transport A (parallel to the above-described transverse direction Q). By way of the linear guide axis y, the cutting bar 8 can be brought into the position assigned to the opposite cutting blade 7 and the spur needle 6 can be brought into engagement with the object web 1 or the cut off material section 11. By way of the linear guide axis x, parallel to the direction of transport A, the spur needle 6 can be actuated so as to transport the cut off material section 11 away from the cutting means 5, 7.

A roller pair 13, 14 is positioned downstream of the two-axis linear drives 2, 10, 9 on both sides. The cut off material section is guided between the two rollers 13, 14, wherein the respective carriers 4, 6 can be detached from said material section. One of the two rollers is embodied as a nip roller 13 and is preferably driven by a servomotor having a phase angle sensor. The second roller functions as a guide roller 14 and is also linearly displaceable via a correspondingly configured solenoid actuator 3. The displacement stroke extends in a linear guide axis y perpendicular to the direction of transport A. Thus, the cut material section 11 can be securely gripped in the roller pair and guided. Also disposed downstream of the roller pair 13, 14 is a light sensor system 15, for example, a photoelectric sensor. This sensor is configured to detect a leading edge of the cut off sheet or material section 11 and to emit a corresponding output signal to a control system. If this control system links this photoelectric sensor signal with the angular position value that is provided by the angular position sensor of the servo drive of the nip roller 13, the control system can determine the position of the material section 11 and can influence or readjust said position by adjusting the speed or acceleration, for example.

Downstream of the photoelectric sensor system, pneumatic suction and blow elements 16 and 17 are disposed, which hold and guide the material section 11 in a known manner for subsequent folding by means of the folding blade 18. Said folding blade can in turn be displaced in the transverse direction Q, perpendicular to the direction of transport A, with a predefined displacement stroke by way of a linear drive in the form of a solenoid actuator 2. The displacement corresponds to the above-described linear guide axis y. The displacement stroke of the folding blade 18 is dimensioned and oriented such that the tip of the folding blade presses the cut off material section 11 between two guide strips 19 in the region of an intended folding line, into the opening of a gripper 20. Said gripper can be actuated for opening and closing by a gripper actuating drive 21. The gripper actuating drive 21 is mounted on a sliding carriage 10, which is mounted in a linear motor 9 so as to be displaceable along the linear guide axis y or transverse direction Q, perpendicular to the direction of transport A. Said linear motor is stationarily mounted.

A sheet delivery unit 22 is situated downstream of the gripper 20. Opening the gripper 20 by way of the actuating drive 21 thereof allows the folded sheet 12 to fall onto the sheet delivery unit 22 and be transported away.

Regarding the sequence of movements of the entire system according to FIG. 1, the following is further stated:

According to the position illustrated in FIG. 1, the cutting means 5, 7 located to the left of the object web 1 in relation to the direction of transport A and the carrier 4, 6 located to the right of the object web 1 are each engaged with the object web. Complementarily, with the cutting means 5, 7 on the right side, the cutting blade support 5 with the cutting blade 7 is retracted to allow sufficient space for the carrier 4, 6 on the right side. Conversely, the cutting means 5, 7 on the left side is extended by the relevant solenoid actuator 2, while the two-axis linear drive 10, 9, 2 on the left has moved the carrier 4, 6 located on the left side away from the cutting site enough that the cutting process by the cutting means 5, 7 located on the left side will not be disrupted. Once the material section 11 has been cut off of the continuous object web 1, the cutting means 5, 7 on the left side will be drawn back out or retracted in the transverse direction Q by the relevant solenoid actuator 2, while the carrier 4, 6 that is still engaged with the cut off material section 11 on the right side is moved by means of its allocated two-axis linear drive 9, 10, 2 away from the cutting point in the direction of the actual folding station. Thus, the cutting means 5, 7 on the left side and the carrier 4, 6 on the right side, and the cutting means 5, 7 on the right side and the carrier 4, 6 on the left side are alternatingly engaged with the material to be processed (object web 1, material section 11). In each case, in the push-pull cycle, the two-axis linear drives 10, 9, 2 on both sides ensure the opposite phase operation of the allocated carriers 4, 6, and the solenoid actuators 2 of the cutting means on both sides ensure the opposite phase extension and retraction of the cutting means 5, 7, which are coordinated by a folding control system.

During the course of the further transport of the cut material sections 11 through the roller pair 13, 14, the material section 11 reaches the region of the folding blade 18 with the allocated gripper 20, which can be opened and closed. This transport movement can be selectively controlled by way of the nip roller 13 with the guide roller 14, which is brought into position by the extended solenoid actuator 3, in functional connection with the photoelectric sensor system 15, wherein the position of the material sections 11 can be calculated and taken into account in the controller on the basis of the output signals from the photoelectric sensor system 15 and the phase angle sensor integrated into the servo drive of the nip roller 13. In this manner, when the material section 11 is pressed by the folding blade 18 into the gripper 20, the guide roller 14, which up to that point has been thrown on, can be retracted in coordination with this step by means of the correspondingly actuated solenoid actuator 3, so that sufficient material for producing the folded sheet will be released.

The embodiment according to FIG. 2 differs from that of FIG. 1, for one, in terms of the special embodiment of the cutting blade 7, in which the shaft of said blade extends across a curved guide shoulder 24 and ends in a pointed cutting edge 23. For another, the spur needle according to FIG. 1 is replaced by a gripper 26, which can be opened and closed, and which is embodied for gripping the leading edge of the cut off material section of the object web 1, which has been curved by means of the cutting edge 23 and the curved guide shoulder 24 of the cutting blade 7. Here again, a gripper actuating drive 21 is used for opening and closing the gripper 26, and can be similar to the gripper actuating drive of the gripper 20 assigned to the folding blade according to FIG. 1. Otherwise, the above statements made in reference to FIG. 1 apply here accordingly.

LIST OF REFERENCE SIGNS

A Direction of movement of the web of print substrate, direction of transport
Q Transverse direction
x Linear guide axis
y Linear guide axis
1 Web of print substrate
2 Solenoid actuator
3 Solenoid actuator
4 Support for spur needles and cutting bar
5 Support for cutting blade
6 Spur needles
7 Cutting blade
8 Cutting bar
9 Linear motor (LIM with long stator)
10 Sliding carriage
11 Cut sheets
12 Folded sheets
13 Nip roller (servo-driven with phase angle sensor)
14 Guide roller
15 Photoelectric sensor for detecting leading edge of sheet
16 Suction element
17 Blow element
18 Folding blade
19 Guide strip
20 Gripper
21 Gripper actuating drive
22 Sheet delivery unit
23 Cutting edge
24 Guide shoulder
25 Guided web end/guided leading edge of sheet
26 Gripper

The invention claimed is:

1. A device for separating individual material sections (11) according to a certain format, from a web-type object web (1), more particularly, a paper or panel of fabric, the device comprising a cutting tool (5, 7, 23) that can be placed in functional connection with the object web (1), and comprising one or more transporting or conveying means, which is or are embodied for removing the cut off material section (11) following the cutting process by the cutting tool (5, 7, 23), wherein the transporting or conveying means comprise at least one driving carrier (4, 6; 20), which is embodied for engaging with or for gripping the object web (1), characterized in that the carrier (4, 6; 20) is mounted on a sliding carriage (10) that can be moved back and forth by way of a linear motor (9), wherein a controller for the linear motor (9) is configured for executing displacement strokes via programming or wiring, which strokes are adjusted or varied according to a section format that is predefined for the material section (11), and wherein the actuation of the carrier and the linear motor is synchronized with the cutting tool (5, 7, 8) via control engineering and further characterized by the arrangement of two carriers (4, 6), one on each of the two sides of the object web (1) or the material section (11) cut off from said web, wherein for the displacement of the carriers (4, 6; 20) according to the section format, each carrier is attached to a movable carriage (10) on one of two linear motors (9), each said motor being equipped with a controller, which is configured for actuating the linear motors in a push-pull process relative to one another by programming or circuit engineering, and exerting opposite or opposite phase displacement strokes for the carriers (4, 6; 20).

2. The device according to claim 1, characterized in that the carrier is attached to the linear motor carriage (10) via a servo device by means of which the carrier (4, 6; 20) can be displaced transversely to the longitudinal direction of the object web (1) or the cut off material section (11).

3. The device according to claim 2, characterized in that the carrier (4, 6; 26) is coupled with or guided by a linear drive system (9, 10, 2) having a plurality of overlapping linear guide axes (x, y) for executing arcuate or curved paths or movements.

4. The device according to claim 3, characterized in that the carrier (4, 6; 26) is coupled with or guided by an XY table or cross table for implementing arcuate or curved paths or movements.

5. The device according to claim 4, characterized in that a movement plane defined by the cross table (9, 10, 2) for the carrier or carriers (4, 6) is arranged perpendicular to the plane that is defined by the object web (1) and by the direction of transport (A) thereof.

6. The device according to claim 5, characterized in that the cross table (9, 10, 2) or two cross tables (9, 10, 2) arranged one on each of the two sides of the object web (1) each have linear guides or linear axes of different lengths, the longer axis of which being permanently attached to a machine frame or machine base.

7. The device according to claim 6, characterized in that a complementary cutting counter tool (8) is allocated to the cutting tool (5, 7), with the object web (1) being guided between said cutting bar and cutting tool and cut into the material sections (11).

8. The device according to claim 7, characterized in that the cutting counter tool (8) is attached together with the carrier (4, 6; 20) to the linear motor sliding carriage (9).

9. An assembly for cutting and folding web-type and sheet-type material, for example, imprinted paper web or imprinted sheets of paper, comprising a separating device for separating individual material sections (11) according to a certain format, from a web-type object web (1), more particularly, a paper or panel of fabric, the separating device comprising a cutting tool (5, 7, 23) that can be placed in functional connection with the object web (1), and comprising one or more transporting or conveying means, which is or are embodied for removing a cut off material section (11) following the cutting process by the cutting tool (5, 7, 23), wherein the transporting or conveying means comprise at least one driving carrier (4, 6; 20), which is embodied for engaging with or for gripping the object web (1), the separating device characterized in that the carrier (4, 6; 20) is mounted on a sliding carriage (10) that can be moved back and forth by way of a linear motor (9), wherein a controller for the linear motor (9) is configured for executing displacement strokes via programming or wiring, which strokes are adjusted or varied according to a section format that is predefined for the material section (11), and wherein the actuation of the carrier and the linear motor is synchronized with the cutting tool (5, 7, 8) via control engineering and the assembly further comprising a folding device for folding a material section (11) and comprising a folding tool (18), which can be placed in engagement with the material section (11) in a region of an intended folding line, wherein a carrier (20) is assigned to cooperate with the folding tool (18) and can be placed in functional connection with the material section (11) or separated therefrom by way of a servo drive (21), the folding device characterized in that the carrier (20) can be detached or withdrawn from the folding tool (18) by means of a sliding carriage that is movable by a linear drive (9), the assembly characterized in that the separating device and the folding device are arranged as successive processing stations in series, in or along a direction of movement (A) of the material.

10. The assembly according to claim 9, characterized in that the direction of movement (A) of the material extends from the separating device to the folding device in a straight line or parallel to the displacement stroke or strokes of the linear motor sliding carriage, with which the carrier (4, 6; 20) assigned to a leading end of the object web (1) that has not yet been cut are coupled.

11. The assembly according to claim 10, characterized in that a proximity sensor system is arranged between the separating device and the folding device, and is thereby aligned with a leading or trailing edge of the cut off material section (11) and is connected at an output side to a control input of the carrier servo drive (21) or other drive controller.

12. The assembly according to claim 11, characterized in that the drive controller is embodied for coordinating one or more linear drives (9) or servo devices (2) for the cutting tool (5, 7; 23) of the separating device or the linear drive (9) or the servo drive (2, 21) for the folding tool (18) and the carrier (20) of the folding device.

13. The assembly according claim 12, characterized in that a tractive device is provided for conveying a cut material section (11) from the separating device into the folding device.

14. The assembly according to claim 13, characterized in that the tractive device comprises two opposing nip rollers (13, 14), the first (13) of which is driven via a servo motor having a phase angle sensor, and the second (14) of which can be displaced or engaged for cooperating with the first, and can then be disengaged by way of a servo drive (3).

15. The assembly according to claim 14, characterized in that an output signal from the phase angle sensor is fed to a higher level drive controller for a coordination of drives for further processing.

16. The assembly according to claim 15, characterized in that the displacement strokes of the linear motor (9) or of the sliding carriage (10) thereof with carriers (4, 6; 20) of the separating device are dimensioned such that the cut off material section (11) gripped by said carriers is transported into an intake region of the tractive device, particularly into an intake nip of the two opposing nip rollers (13, 14).

17. The assembly according to claim 16, characterized by a higher level drive controller for a coordination or simultaneous control of drives of the separating device or the folding device, wherein as a control command variable, signals are processed, which represent the position of markings on the object web (1).

18. The assembly according to claim 17, characterized in that in the higher level drive controller a synchronization of movements of the cutting tool or folding tool (7, 18) or the carriers (6, 20) is implemented via respective linear drives (9) thereof with respect to object web markings.

* * * * *